US005751252A

United States Patent [19]

Phillips

[11] Patent Number: 5,751,252

[45] Date of Patent: May 12, 1998

[54] METHOD AND ANTENNA FOR PROVIDING AN OMNIDIRECTIONAL PATTERN

[75] Inventor: James Patrick Phillips, Lake in the Hills, Ill.

[73] Assignee: Motorola, Inc., Schaumburg

[21] Appl. No.: 959,291

[22] Filed: Oct. 24, 1997

Related U.S. Application Data

[63] Continuation of Ser. No. 493,039, Jun. 21, 1995, abandoned.

[51] Int. Cl.[6] ..... H01Q 21/00

[52] U.S. Cl. ..... 343/726; 343/741; 343/821

[58] Field of Search ..... 343/726, 741, 343/727, 746, 866, 870, 742, 744, 748, 821; H01Q 21/00

[56] References Cited

U.S. PATENT DOCUMENTS

| | | | |
|---|---|---|---|
| 1,818,639 | 12/1931 | Meissner | 343/726 |
| 2,953,782 | 4/1960 | Byatt | 343/726 |
| 3,474,452 | 10/1969 | Bogner | 343/744 |
| 4,183,027 | 1/1980 | Ehrenspeck | 343/726 |
| 4,340,891 | 7/1982 | Phillips | 343/713 |
| 4,801,944 | 1/1989 | Madnick et al. | 343/741 |
| 4,809,009 | 2/1989 | Grimes et al. | 343/726 |
| 5,038,150 | 8/1991 | Bains | 342/373 |
| 5,198,826 | 3/1993 | Ito | 343/726 |
| 5,300,936 | 4/1994 | Izadian | 343/741 |
| 5,469,180 | 11/1995 | Wiggenhorn | 343/741 |

*Primary Examiner*—Donald T. Hajec
*Assistant Examiner*—Tan Ho
*Attorney, Agent, or Firm*—Darleen J. Stockley

[57] ABSTRACT

The present invention provides a method (400) and antenna (100) for providing an omnidirectional pattern. The antenna (100) is smaller than prior art omnidirectional antennas with the same bandwidth. The smaller size is made possible by the use of at least one capacitive element (104) at a discontinuity in the loop (102). The pattern is balanced and therefore the omnidirectionality is maintained by the current maximum (110 and 112) that are created by the capacitive element (104).

4 Claims, 4 Drawing Sheets

FIG. 4 400

METHOD AND ANTENNA FOR PROVIDING AN OMNIDIRECTIONAL PATTERN

This is a continuation of application Ser. No. 08/493.039, filed Jun. 21, 1995 and now abandoned.

FIELD OF THE INVENTION

The present invention relates generally to antennas, and more particularly to omnidirectional antennas.

BACKGROUND OF THE INVENTION

Omnidirectional loop antennas in prior art are small with regard to the operating wavelength and therefore have a narrow frequency bandwidth of operation and are not well suited for many communication systems. To increase the operating bandwidth the size of the loop is increased. As the loop is made larger, the current distribution around the loop is no longer uniform and the radiation pattern is not omnidirectional but has directionality. As the bandwidth is increased, the size of the antenna increases and the Omnidirectional pattern may be affected. This can be expressed in the form of a table of different size loops expressed in terms of the wavelength of the center frequency of the operating band as shown below. As the loop varies from a circumference of 0.2 wavelengths to 0.5 wavelengths the unusable bandwidth as expressed as a percentage of the center frequency varies from 0.14% to 9.0%. However, the uniformity of the pattern degrades . If the maximum response is compared to the minimum response in the azimuth plane this can be expressed in decibels and shown in the table below.

| Circumference in Wavelengths | Radiation Resistance | Bandwidth in Percentage | Azimuth Max. to Minimum in dB |
|---|---|---|---|
| 0.2 | 0.32 Ohms | 0.14% | 1.0 dB |
| 0.3 | 1.5 Ohms | 0.56% | 2.0 dB |
| 0.4 | 5.18 Ohms | 2.33% | 4.0 dB |
| 0.5 | 12.3 Ohms | 6.45%. | 6.0 dB |

When the loop is made large enough for the bandwidth to be great enough to be usable in typical communication systems, typically greater than 5.0%, then the azimuth pattern becomes non-uniform with peaks and nulls. These nulls produce degraded performance when they are in the direction of the site of the other antenna in the RF communication link.

Omnidirectional, vertically polarized antennas, usually called electric dipoles, are well known and often used in communication systems. In land mobile, cellular and other base-to-mobile communication systems, the signal is reflected from many surrounding objects and these reflections combine in constructive and destructive ways. When the combination is destructive, the signal is canceled and communication is impossible. If however, a second antenna using horizontal polarization was available, an alternate or diversity communication path would be available. For this second path to be effective the second antenna has to be isolated and decorrelated from the first. A very effective way of accomplishing this is to have the polarizations of the antennas be orthogonal. Because the first antennas are usually vertically polarized, the second antenna should be horizontally polarized.

There exists, therefore, a need for a method and antenna for providing omnidirectional pattern, wherein the antenna is smaller than prior art with comparable bandwidth.

DETAILED DESCRIPTION OF THE PREFERRED EMBODIMENTS

Generally, the present invention provides a method and antenna for providing an omnidirectional pattern with a small structure.

Figure 1:
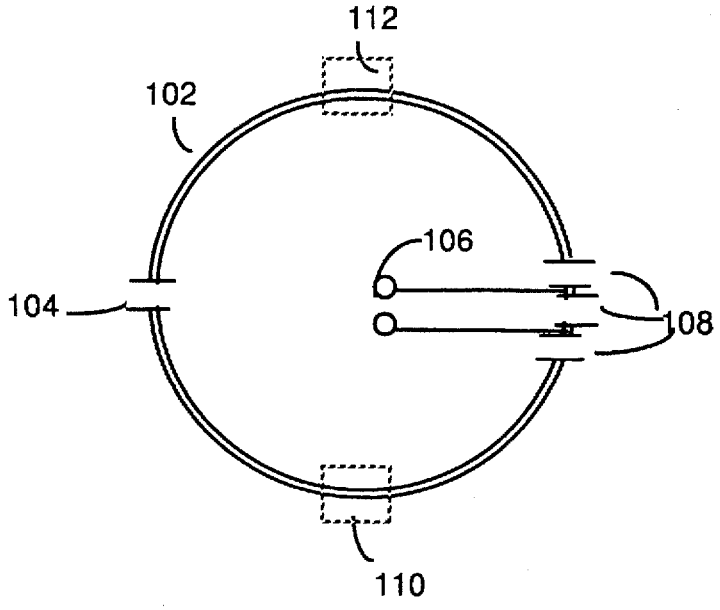
FIG. 1 is a diagram of one embodiment of an antenna for providing an omnidirectional polarized pattern in accordance with the present invention.

The present invention is more fully described in FIGS. 1–4. FIG. 1, numeral 100, is a diagram of one embodiment of an antenna for providing an omnidirectional pattern in accordance with the present invention. The loop (102) is a discontinuous loop comprising at least a first capacitive element (104), feed point (106), and matching network (108). A discontinuity is introduced to balance the omnidirectional transmission pattern. By using the capacitive element (104), current maximums (110 and 112) are located on either side of the loop (102) to balance the transmission pattern. At 800 MHz, the capacitors are about 0.7 pico-Farads.

Figure 2:
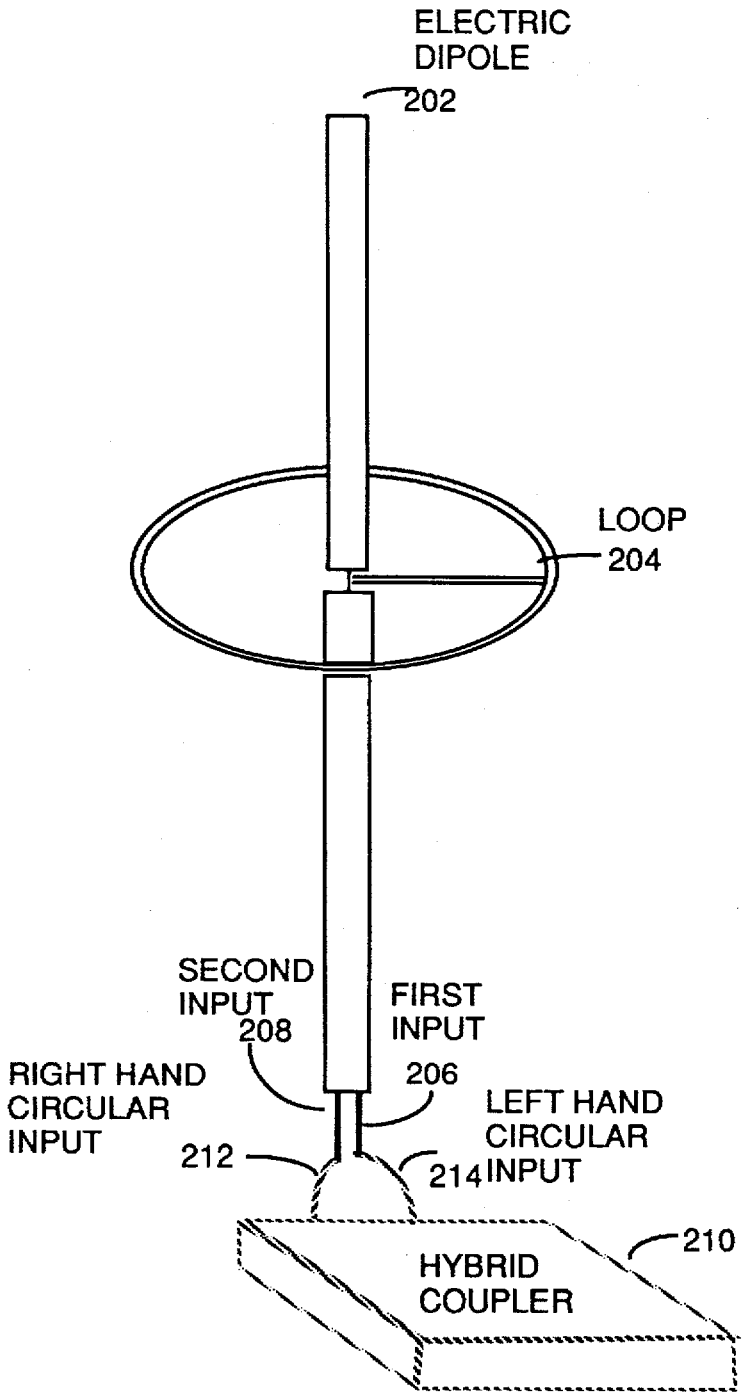
FIG. 2 is a diagram of a second embodiment of an antenna for providing an omnidirectional polarized pattern in accordance with the present invention.

FIG. 2, numeral 200, is a diagram of a second embodiment of an antenna for providing an omnidirectional pattern in accordance with the present invention. The antenna (200) comprises an electric dipole (202) and a loop (204). The uniformity of omnidirectionality is obtained within 0.2 dB.

The electric dipole (202) receives a first input (206). The loop (204) receives a second input (208). The electric dipole (202) utilizes a dipole integral "bazooka" balun for common mode operation. The loop (204) is shown in greater detail in FIG. 1. The loop (204) utilizes an infinite loop balun for common mode operation. The loop balun is achieved by using a twisted pair transmission line with a small diameter for the wires of the transmission line.

The antenna may include a hybrid coupler (210) for inputting one sense circular polarization to the first input (206) and the opposite sense to the second input (208). The second input (208) is equal in amplitude to the first input (206) and the phase of the second input (208) is in quadrature with the phase of the first input (206). The hybrid coupler (210) provides the first input (206) and the second input (208) with a left hand circular input (214) and a right hand circular input (212).

The electric dipole (202) consists of two conductive cylinders approximately one quarter wavelength and equal in size and located collinear with each other. These are made of brass but any highly conductive metal may be used. The length of each cylinder is slightly shorter that one quarter of a wavelength at the center frequency the center of the operating band of frequencies. The diameter of the cylinders is about one tenth of the length. Connection to the dipole is made across a gap between the two cylinders with the coaxial cable running coaxially with the lower cylinder. The lower cylinder forms the balun in addition to being one section of the dipole. The loop is made from copper tubing about one two-hundredth of a wavelength in diameter. The diameter of the loop is one seventh of a wavelength. The loop is discontinuous at two points and capacitors are connected across the discontinuities. The value of the capacitors is selected to cause resonance at the center frequency of operation. At 800 MHz, the capacitors are about 0.7 pico-Farads. Because the circumference of the loop is nearly one half wavelength, the current distribution is non uniform around the loop. Without the capacitors a single current maximum occurs which is therefore offset from the center of the loop. The hybrid couplers (210) are commercially available.

Figure 3:
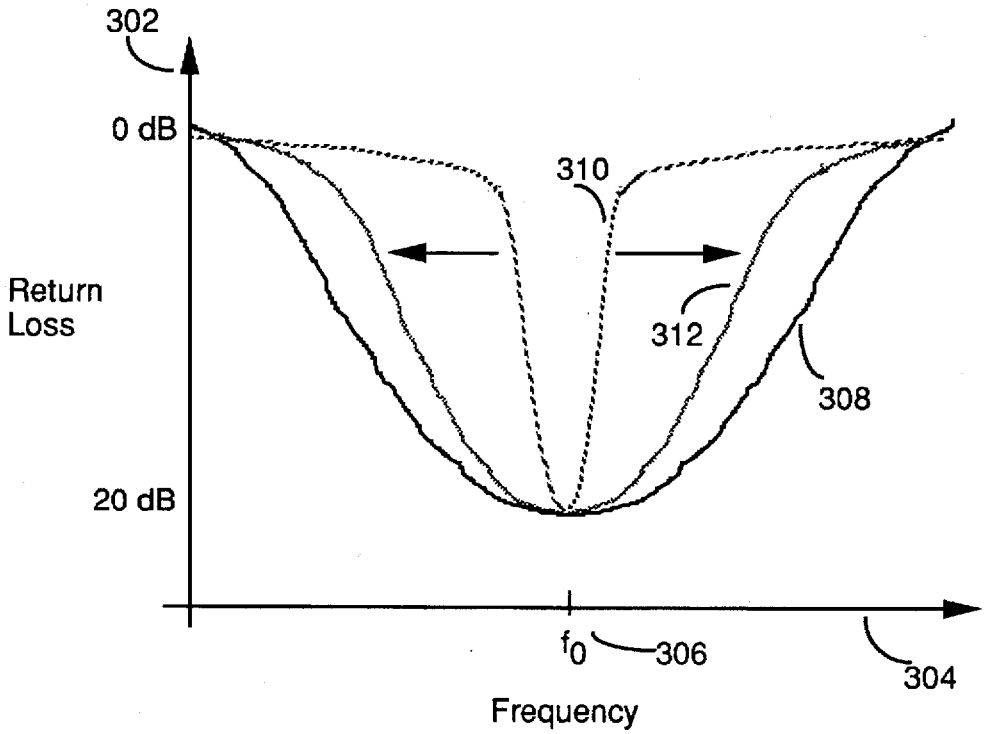
FIG. 3 is a graphical representation of return loss of the loop antenna in accordance with the present invention.

FIG. 3, numeral 300, is a graphical representation of return loss in accordance with the present invention. The return loss (302) is a function of frequency (304). The return losses of the electric dipole (308) and the loop (312) are centered a center frequency $f_0$ (306). The return loss of prior art loops (310) has a substantially narrower bandwidth than the return loss of the loop in the present invention (312).

"Q" is defined in the art to be ratio of two pi times the energy stored by a reactive element to the energy dissipated over one cycle in a resonant circuit. Q is therefore equal to the ratio of the reactance of the loop to the radiation resistance of the loop as shown below.

$$Q=XI/Rr$$

Where: XI=the inductive reactance of the loop, and Rr=the radiation resistance of the loop.

"Q" is also a measure of how much usable frequency bandwidth an antenna provides. It is equal to the center frequency of operation divided by the half-power bandwidth as shown below.

$$Q=Fcenter/(Fmax-Fmin)$$

Where Fmax is the maximum frequency of operation, Fmin is the minimum frequency of operation, and Fcenter is the center frequency of operation.

To obtain the usable bandwidths of 5%, which are typical of many communication systems, the Q should be less that 20. This requires that the reactance "XI" be no more than 20 times the radiation resistance, "Rr" of equation 1.

For electrically small loops, the radiation resistance is very small but it increases as the fourth power of the diameter of the loop. The reactance is much larger than the resistance but it increases only linearly with diameter. Therefore, an infinitesimally small loop has an infinite "Q" and it decreases rapidly as the loop is made larger.

Figure 4:
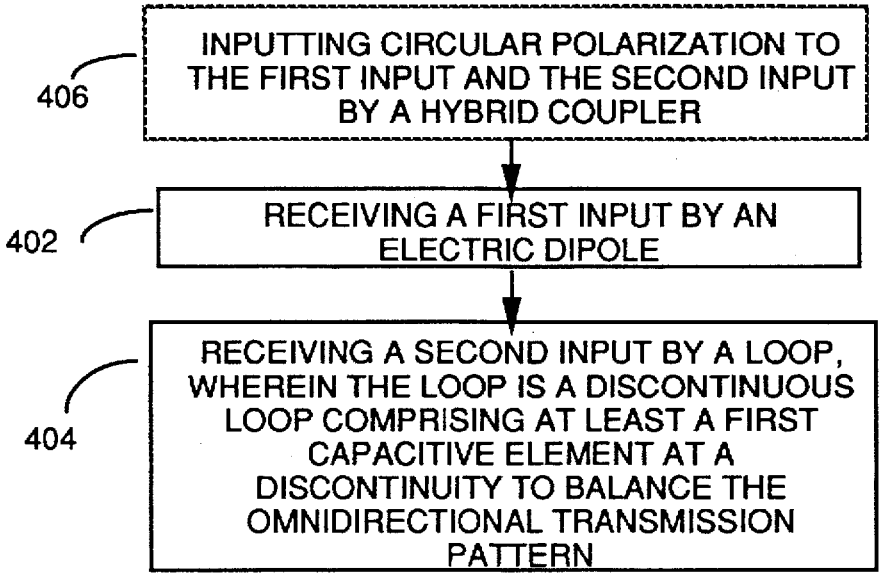
FIG. 4 is a flow diagram of one embodiment of step for implementing a method for providing an omnidirectional pattern in accordance with the present invention.

FIG. 4, numeral 400, is a flow diagram of one embodiment of steps for implementing a method for providing both horizontally and vertically polarized omnidirectional patterns in accordance with the present invention. A first input is received by an electric dipole (402), and a second input is received by a loop (404). The loop is a discontinuous loop comprising at least a first capacitive element at a discontinuity to balance the omnidirectional transmission pattern.

The electric dipole utilizes a coaxial or "bazooka" dipole balun to allow connection coaxially to the dipole. The loop utilizes a separate balun for operation co-located with the dipole. The loop balun is achieved by a coaxial or "bazooka" balun or by using a twisted-pair transmission line with a small diameter wires for each conductor. The transmission line connecting to the loop is decoupled from the antenna structure by using the same coaxial or "bazooka" balun used by the electric dipole . The separate coaxial feedlines may be located in parallel while passing through the lower tube which forms the lower arm of the dipole and the balun for the electric dipole.

Circular polarization may be provided by connecting the co-located electric dipole and loop to a common RF signal source with equal RF signal magnitude and with a phase quadrature relationship between them. The first input for the electric dipole and the second input for the loop antenna, by a hybrid coupler (406). The second input is equal in amplitude to the first input and the phase of the second input is in quadrature with the phase of the first input. A hybrid combiner provides two isolated inputs with orthogonal quadrature relationships. The hybrid can thus provide both left-hand and right-hand circularly polarized signals simultaneously and independently.

Thus, the present invention provides a method and antenna for providing an electrically small, omnidirectional, horizontally polarized pattern. The antenna element may be co-located and independently connected with an electric dipole. With such a structure, a multiplicity of wave polarizations are available for diversity to improve the reliability of a communications system. In-door, RF, data communication systems are improved by using circular polarization. A small antenna of this type will have application in cordless phone and micro cellular base stations. The advantages are the antenna is a smaller size than prior art of the same bandwidth due to being integrated and collocated with the dipole, a receiving antenna such as a hand held antenna, can be in any orientation, and the antenna can be low cost with baluns.

Although exemplary embodiments are described above, it will be obvious to those skilled in the art that many alterations and modifications may be made without departing from the invention. Accordingly, it is intended that all such alterations and modifications be included within the spirit and scope of the invention as defined in the appended claims.

We claim:

1. A method for providing an improved omnidirectional pattern, the method comprising:

receiving a first input by an electric dipole; and receiving a second input by a conductive loop, wherein the conductive loop is a discontinuous loop comprising at least a first capacitive element at a discontinuity to balance the omnidirectional transmission pattern, further comprising an initial step of inputting circular polarization to the first input and the second input by a hybrid coupler, and the antenna further comprises a hybrid coupler for inputting circular polarization, wherein the second input is equal in amplitude to the first input and the phase of the second input is in quadrature with the phase of the first input, wherein the electric dipole includes two conductive cylinders, each having a length of approximately one quarter of a wavelength of a center frequency of an operating band of frequencies and the conductive cylinders are equal in size, located collinear with each other and have a diameter of substantially one-tenth of the length, wherein a diameter of the conductive loop is substantially one-seventh of the wavelength of the center frequency of the operating band of frequencies, and wherein uniformity of omnidirectionality is obtained within 0.2 dB.

2. An antenna for providing an omnidirectional pattern, the antenna comprising:

a conductive loop oriented in a horizontal plane for receiving a first input to provide a current distribution, the loop contains at least a first discontinuity and is larger than 0.5 wavelengths in circumference; and at least a first capacitive element at the discontinuities to modify the current distribution on the conductive loop and thus provide the omnidirectional pattern, further comprising an electric dipole, operably coupled to the conductive loop, passing through a center of the conductive loop and perpendicular to the horizontal plane of the conductive loop, for receiving a second input, and wherein the antenna further comprises a hybrid coupler for inputting circular polarization, wherein the second input is equal in amplitude to the first input and the phase of the second input is in quadrature with the phase of the first input, wherein the electric dipole includes two collinear conductive cylinders, one on each side of the horizontal plane of the conductive loop, each conductive cylinder having a length of approximately one quarter of a wavelength of a center frequency of an operating band of frequencies, the conductive cylinders being equal in size and each conductive cylinder having a diameter of substantially one-tenth of the length of the conductive cylinder, wherein a diameter of the conductive loop is substantially one-seventh of the wavelength of the center frequency of the operating band of frequencies, and wherein uniformity of omnidirectionality is obtained within 0.2 dB.

3. The antenna of claim 2 wherein the conductive loop utilizes a loop balun that is one of a coaxial balun and a balun for common mode operation.

4. The antenna of claim 2, wherein the electric dipole utilizes a dipole balun that is one of a coaxial balun and a balun for common mode operation.

* * * * *